US008432100B2

(12) United States Patent
Lee

(10) Patent No.: US 8,432,100 B2
(45) **Date of Patent: *Apr. 30, 2013**

(54) ORGANIC LIGHT EMITTING DISPLAY DEVICE AND DRIVING METHOD FOR THE SAME

(75) Inventor: Jae Sung Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 49 days.

This patent is subject to a terminal disclaimer.

(21) Appl. No.: 12/497,374

(22) Filed: Jul. 2, 2009

(65) Prior Publication Data

US 2009/0267973 A1 Oct. 29, 2009

Related U.S. Application Data

(63) Continuation of application No. 11/585,690, filed on Oct. 23, 2006, now Pat. No. 7,728,526.

(30) Foreign Application Priority Data

Mar. 29, 2006 (KR) ..... 2006-0028613

(51) Int. Cl.
*G09G 3/10* (2006.01)
*G09G 3/34* (2006.01)

(52) U.S. Cl.
USPC ..... 315/169.3; 345/82; 345/204

(58) Field of Classification Search .... 315/169.1–169.4, 315/291, 307; 345/76–82, 102, 204
See application file for complete search history.

(56) References Cited

U.S. PATENT DOCUMENTS 6,016,037 A * 1/2000 Kuribayashi et al. ..... 315/169.3
6,023,532 A 2/2000 Kanesaka et al.
7,071,906 B2 * 7/2006 Nishitani et al. ..... 345/81

(Continued)

FOREIGN PATENT DOCUMENTS

CN 1061502 A 9/1997
EP 1 335 347 A1 8/2003

(Continued)

OTHER PUBLICATIONS

Korean Patent Abstracts for Publication No. 1020020092075 A; Date of Publication of Application Dec. 11, 2002 in the name of Mun.

(Continued)

*Primary Examiner* — Jimmy Vu
(74) *Attorney, Agent, or Firm* — Christie, Parker & Hale, LLP

(57) ABSTRACT

An organic light emitting display device is provided. The device includes a photo sensor adapted to: sense a brightness of ambient light; output a pulse width of an emission control signal corresponding to a sensed brightness of the ambient light; and output a gamma compensation coefficient corresponding to the sensed brightness of the ambient light and a user selected brightness. The device also includes a gamma compensation circuit adapted to adjust a magnitude of a voltage between a plurality of gradation voltages according to the output gamma compensation coefficient. The device also includes a scan driver and a data driver. The device also includes a pixel portion including a pixel adapted to: emit light according to the data signal, the scan signal, and the emission control signal; and display an image corresponding to the user selected brightness.

2 Claims, 6 Drawing Sheets

U.S. PATENT DOCUMENTS

| | | | | |
|---|---|---|---|---|
| 7,106,285 | B2 * | 9/2006 | Naugler | 345/87 |
| 7,468,722 | B2 * | 12/2008 | Ferguson | 345/102 |
| 7,728,526 | B2 * | 6/2010 | Lee | 315/169.3 |
| 2002/0011978 | A1 | 1/2002 | Yamazaki et al. | |
| 2003/0001815 | A1 | 1/2003 | Cui | |
| 2003/0043137 | A1 | 3/2003 | Nakamura | |
| 2003/0058202 | A1 | 3/2003 | Evanicky et al. | |
| 2003/0141434 | A1 | 7/2003 | Ishikawa et al. | |
| 2003/0210221 | A1 * | 11/2003 | Aleksic | 345/102 |
| 2004/0012340 | A1 | 1/2004 | Yasuda et al. | |
| 2004/0012556 | A1 * | 1/2004 | Yong et al. | 345/102 |
| 2004/0032382 | A1 | 2/2004 | Cok et al. | |
| 2004/0036706 | A1 | 2/2004 | Endou | |
| 2005/0030267 | A1 | 2/2005 | Tanghe et al. | |
| 2005/0264550 | A1 | 12/2005 | Ohshima et al. | |

FOREIGN PATENT DOCUMENTS

| | | |
|---|---|---|
| JP | 5-153594 | 6/1993 |
| JP | 6-161384 | 6/1994 |
| JP | 06-178238 | 6/1994 |
| JP | 10-108041 | 4/1998 |
| JP | 2000-293133 | 10/2000 |
| JP | 2001-092413 | 4/2001 |
| JP | 2001-184016 | 7/2001 |
| JP | 2003-228330 | 8/2003 |
| JP | 2004-029714 | 1/2004 |
| JP | 2004-151187 | 5/2004 |
| KR | 2002-0054874 | 7/2002 |
| KR | 2002-0092075 | 12/2002 |
| KR | 2003-0065640 | 8/2003 |
| KR | 2003-0072996 | 9/2003 |
| KR | 2003-0081610 | 10/2003 |
| KR | 10-2003-0086473 | 11/2003 |
| KR | 2003-0095135 | 12/2003 |
| KR | 10-0421835 | 2/2004 |
| WO | WO 03/091979 A1 | 11/2003 |

OTHER PUBLICATIONS

Korean Patent Abstracts, Publication No. 1020030065640 A, dated Aug. 9, 2003, in the name of Ho Yong Jung et al.

Korean Patent Abstracts, Publication No. 1020030072996 A, dated Sep. 19, 2003, in the name of Gil Jae Lee et al.

Korean Patent Abstracts, Publication No. 1020030081610 A, dated Oct. 22, 2003, in the name of O Gyeong Kwon et al.

Korean Patent Abstracts, Publication No. 1020030095135 A, dated Dec. 18, 2003, in the name of O Gyeong Kwon.

Korean Patent Abstracts for Publication No. 100421835 B1; Date of Publication of Application Feb. 25, 2004 in the name of Kim, corresponding to Application No. 1019960045279.

European Search Report dated Sep. 14, 2005, for European application 05104919.5.

China Office action dated Aug. 3, 2007, for China application 200510077961.3.

U.S. Office action dated Jul. 11, 2008, for related U.S. Appl. No. 11/154,271.

U.S. Office action dated Dec. 16, 2008, for related U.S. Appl. No. 11/154,271.

www.allaboutcircuits.com, Flash ADC, Dec. 8, 2003, first figure and corresponding description.

Japanese Office action dated Aug. 4, 2009, for corresponding Japanese application 2005-114963.

U.S. Notice of Allowance dated Sep. 17, 2009, for corresponding U.S. Appl. No. 11/585,690.

U.S. Office action dated Mar. 6, 2009, for related U.S. Appl. No. 11/585,690.

U.S. Office action dated May 11, 2009, for related U.S. Appl. 11/154,271.

Patent Abstracts of Japan, Publication No. 10-108041, dated Apr. 24, 1998, in the name of Masahiro Kitaura.

Patent Abstracts of Japan, Publication No. 2004-029714, dated Jan. 29, 2004, in the name of Tadashi Yamada.

* cited by examiner

ORGANIC LIGHT EMITTING DISPLAY DEVICE AND DRIVING METHOD FOR THE SAME

CROSS-REFERENCE TO RELATED APPLICATIONS

This application is a continuation of U.S. application Ser. No. 11/585,690 filed on Oct. 23, 2006 now U.S. Pat. No. 7,728,526, incorporated by reference herein, which claims priority to and the benefit of Korean Patent Application No. 10-2006-0028613, filed on Mar. 29, 2006, in the Korean Intellectual Property Office, the entire content of which is incorporated herein by reference.

BACKGROUND

1. Field of the Invention

The present invention relates to an organic light emitting display device and a driving method for the same, and more particularly, to an organic light emitting display device and a driving method that adjusts luminance according to brightness of ambient light.

2. Discussion of Related Art

A flat panel display includes a display region defined by a plurality of pixels arranged on a substrate in a form of a matrix, and displays an image by selectively applying a data signal to the pixels to which a scan line and a data line are connected.

A flat panel display is classified into an active matrix type and a passive matrix type according to its drive type. In a point of resolution, contrast, and operation speed, the active matrix type flat panel display which selectively lights every unit pixel has been widely used. An organic light emitting is one such example of a flat panel display.

In an organic light emitting display device, when a luminance of an ambient light is increased, a user may not be able to recognize an exact image. When a luminance of an ambient light is reduced, a user recognizes higher than a set luminance. Accordingly, when the ambient light changes, it may become difficult for the user to recognize an image.

SUMMARY

One embodiment of the present invention provides an organic light emitting display device. The device includes a photo sensor adapted to: sense a brightness of ambient light; output a pulse width of an emission control signal corresponding to a sensed brightness of the ambient light; and output a gamma compensation coefficient corresponding to the sensed brightness of the ambient light and a user selected brightness. The device also includes a gamma compensation circuit adapted to adjust a magnitude of a voltage between a plurality of gradation voltages according to the output gamma compensation coefficient. The device also includes a scan driver and a data driver. The scan driver is adapted to: adjust the pulse width of the emission control signal according to the pulse width of the emission control signal output from the photo sensor; and generate and transfer a scan signal and an emission control signal to the pixel portion. The data driver is adapted to generate and transfer a data signal to the pixel portion. The device also includes a pixel portion including a pixel adapted to: emit light according to the data signal, the scan signal, and the emission control signal; and display an image corresponding to the user selected brightness.

The photo sensor includes a plurality of registers divided into a plurality of groups, wherein the same gamma compensation coefficient but a plurality of different emission times are stored in the plurality of registers in a same group. One of the plurality of registers is selected from the plurality of registers in the photo sensor according to the sensed brightness of the ambient light. The photo sensor further includes: an optical sensing section adapted to output an analog sensing signal corresponding to the sensed brightness of the ambient light; an analog-to-digital converter adapted to convert the analog sensing signal from the optical sensing section into a digital sensing signal; and a counter adapted to count a predetermined number during one frame period and generate a corresponding counting signal. The photo sensor further includes: a conversion processor adapted to output a control signal based on the digital sensing signal and the counting signal; a plurality of registers adapted to separate the sensed brightness of the ambient light into a plurality of stages of brightness, and store a plurality of register set values and a plurality of emission times of a pixel corresponding to the plurality of stages; and a first selector adapted to select and output one of the plurality of register set values according to the control signal output from the conversion processor. The photo sensor further includes: a second selector adapted to provide an output for displaying the image after adjusting a luminance corresponding to the sensed brightness of the ambient light or for displaying the image with a predetermined luminance.

A gamma compensation signal output from the gamma compensation circuit adjusts the data signal. The gamma compensation circuit includes: an amplitude control register adapted to control an upper stage gradation voltage and a lower stage gradation voltage according to the plurality of register set values; a curve control register adapted to select an intermediate stage gradation voltage according to a second register set value to control a gamma curve; and a first selecting section adapted to select the upper stage gradation voltage by a first register set bit value output from the amplitude control register. The gamma compensation circuit also includes: a second selecting section adapted to select the lower stage gradation voltage by a third register set bit output from the amplitude control register; a third selecting section adapted to output a first intermediate stage gradation voltage by a fourth register set bit value output from the curve control register; and a fourth selecting section adapted to output a second intermediate stage gradation voltage by a fifth register set bit value output from the curve control register. The gamma compensation circuit also includes: a fifth selecting section adapted to output a third intermediate stage gradation voltage by a fifth register set bit value output from the curve control register; a sixth selecting section adapted to output a fourth intermediate stage gradation voltage by a sixth register set bit value output from the curve control register; and a gradation voltage amplifier adapted to output a plurality of gradation voltages corresponding to a plurality of gradation voltages to be expressed. A different value is set as a luminance change of the pixel portion when the sensed brightness of the ambient light becomes brighter or when the sensed brightness of ambient light becomes darker, and the luminance change occurs according to a hysteresis curve. Additionally, the analog-to-digital converter compares the analog sensing signal with a reference voltage, and generates the digital sensing signal according to a compared result. Further, the reference voltage changes corresponding to the sensed brightness of the ambient light. A different voltage value is set as a reference voltage when the sensed brightness of the ambient light becomes brighter and when the sensed brightness of the ambient light becomes darker.

Another embodiment of the invention provides a method for driving an organic light emitting display device. The method includes: dividing a luminance of a pixel portion into a plurality of stages, and selecting one of the plurality of stages to adjust voltage differences between gradation voltages; and adjusting an emission time of the pixel portion corresponding to a sensed brightness of an ambient light. The plurality of stages include a dark stage, an intermediate stage, and a bright stage. The emission time of the pixel portion is adjusted according to a reference voltage corresponding to a sensed brightness of an ambient light in each of the dark stage, the intermediate stage, and the bright stage. The emission time of the pixel portion is adjusted according to a reference voltage corresponding to a sensed brightness of an ambient light, and a different voltage value is set as the reference voltage when the sensed brightness of the ambient light becomes brighter and when the sensed brightness of the ambient light becomes darker.

DETAILED DESCRIPTION

Figure 1:
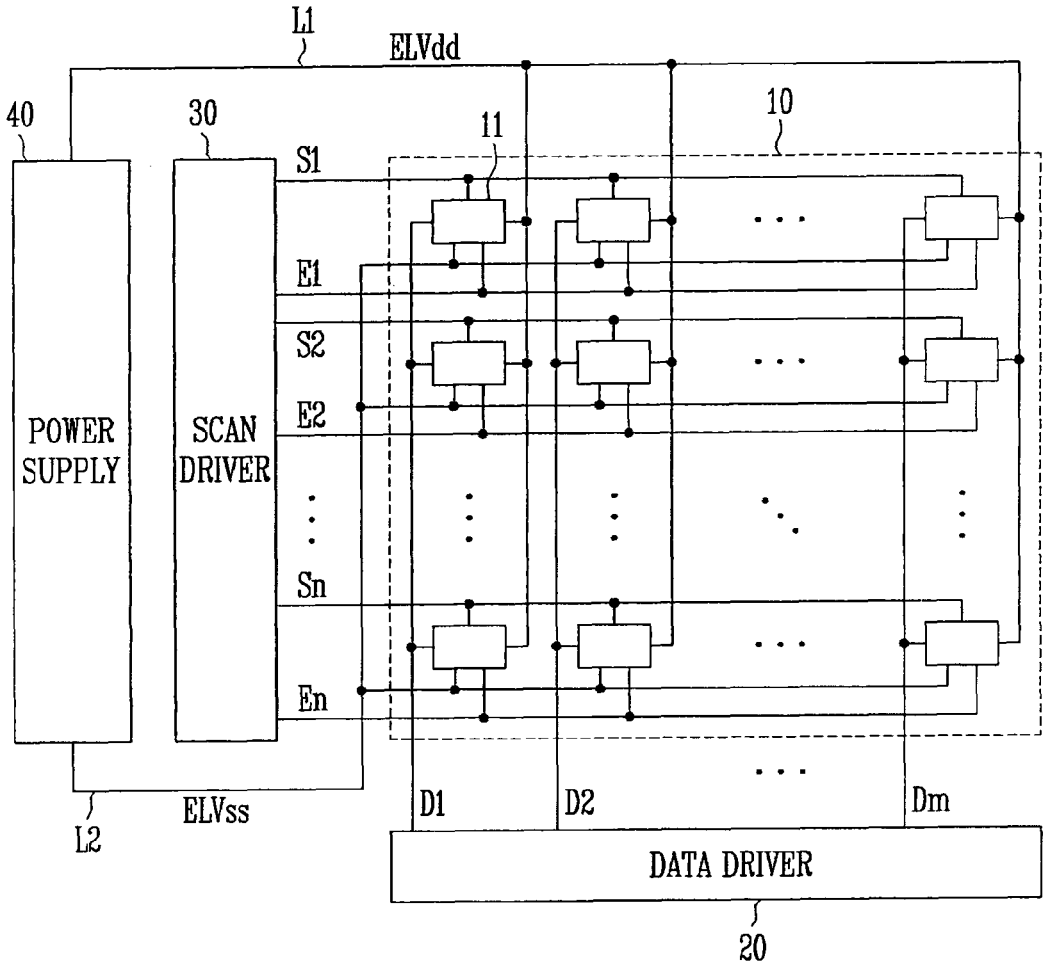
FIG. 1 (CONVENTIONAL ART)
FIG. 1 is a schematic diagram showing a circuit of a conventional organic light emitting display device.

With reference to FIG. 1, an embodiment of a conventional organic light emitting display device includes a pixel portion 10, a data driver 20, a scan driver 30, and a power supply 40. The conventional organic light emitting display device having the aforementioned construction displays an image with a set luminance. The pixel portion 10 includes a plurality of pixels 11, a plurality of scan lines S1, S2, . . . , Sn, a plurality of emission control lines E1, E2, . . . , En and a plurality of data lines D1, D2, . . . , Dm. The pixel 11 includes a pixel circuit (not shown) and a light emitting diode (not shown). The pixel circuit is connected to the scan lines S1, S2, . . . , Sn, the emission control lines E1, E2, . . . , En and the data lines D1, D2, . . . , Dm. The pixel circuit receives a scan signal and a data signal from the scan lines S1, S2, . . . , Sn and the data lines D1, D2, . . . , Dm, and transfers them to the light emitting diode. The light emitting diode includes a first electrode and a second electrode. When an electric current flows from the first electrode to the second electrode, the light emitting diode emits light according to a gradation value corresponding to the electric current.

The data driver 20 is connected to the plurality of data lines D1, D2, . . . , Dm, and transfers a data signal to the pixel portion 10. The data signal is transferred to one column of the pixel portion 10 in parallel.

The scan driver 30 is connected to the plurality of scan lines S1, S2, . . . , Sn, and the plurality of emission control lines E1, E2, . . . , En. The scan driver 30 transfers a scan signal to the pixel portion 10, thereby providing a data signal to a row of the pixel portion 10 selected by the scan signal.

Figure 2:
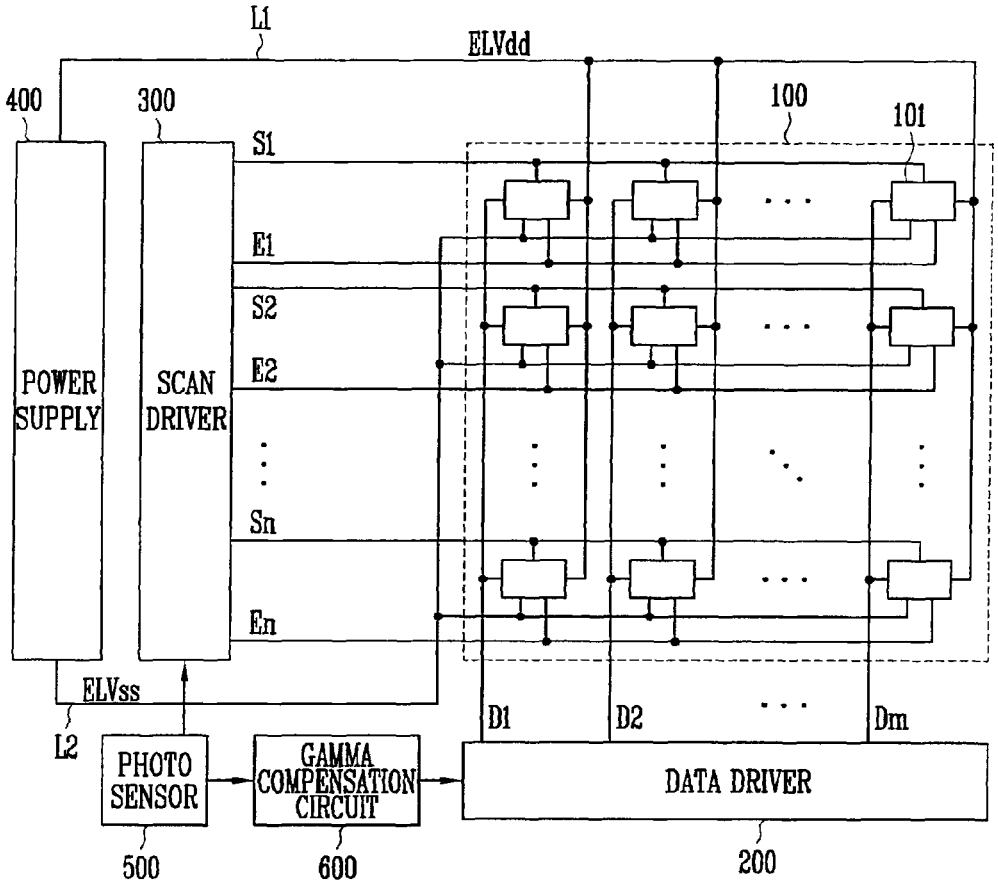
FIG. 2 is schematic diagram showing a circuit of an organic light emitting display device according to an embodiment of the present invention.

FIG. 2 is schematic diagram showing a circuit of an organic light emitting display device according to an embodiment of the present invention. With reference to FIG. 2, one embodiment of an organic light emitting display device includes a pixel portion 100, a data driver 200, a scan driver 300, a power supply 400, a photo sensor 500 and a gamma compensation circuit 600. The pixel portion 100 includes n scan lines S1, S2, . . . , Sn, n emission control lines E1, E2, . . . , En, m data lines D1, D2, . . . , Dm, a plurality of pixels 101, a first power line L1, and a second power line L2. The n scan lines S1, S2, . . . , Sn, and the n emission control lines E1, E2, . . . , En are arranged in a row direction. The m data lines D1, D2, . . . , Dm are arranged in a column direction. The plurality of pixels 101 are electrically coupled with the n scan lines S1, S2, . . . , Sn, the n emission control lines E1, E2, . . . , En, and the m data lines D1, D2, . . . , Dm. The first power line L1 supplies a first power source ELVdd to the pixel portion 100. The second power line L2 supplies a second power source ELVss to the pixel portion 100. Here, the second power line L2 is equivalently expressed. The second power line L2 is formed at an entire region of the pixel portion 100 and can be electrically coupled with each pixel 101. Further, the pixel portion 100 can display an image with a dark stage, an intermediate stage, and a bright stage. One of the dark stage, the intermediate stage or the bright stage can be selected by a user according to the user's taste or power consumption constraints.

The data driver 200 transfers a compensated data signal to the data lines D1, D2, . . . , Dm according to a control signal from the photo sensor 500. The data driver 200 generates the compensated data signal by changing a gamma compensation signal according to a selected one of the dark stage, the intermediate stage or the bright stage.

The scan driver 300 provides a scan signal to the scan lines S1, S2, . . . , Sn, and provides an emission control signal to the emission control lines E1, E2, . . . , En. Respective rows of the pixel portion 100 are sequentially selected by the scan signal so that a data signal is transferred to a selected row and an emission time of a pixel is determined based on a pulse width of an emission control signal. Further, the scan driver 300 adjusts a pulse width of the emission control signal according to a control signal from the photo sensor 500. Here, although the scan driver 300 generates and outputs the emission control signal, the emission control lines E1, E2, . . . , En are associated with a special driver (not shown) and the emission control signal can be transferred to the pixel portion 100.

The power supply 400 supplies a first power source ELVdd through the first power line L1, and supplies a second power source ELVss through the second power line L2.

The photo sensor 500 generates a sensing signal corresponding to a brightness of an ambient light and adjusts a luminance of the pixel portion 100 based on the sensing signal. The photo sensor 500 allows a user to select one of the dark stage, the intermediate stage or the bright stage with the result that the pixel portion 100 may display a corresponding an image. The photo sensor 500 selects and outputs a control signal according to a selected one of the dark stage, the intermediate stage or the bright stage, as well as the sensing signal. Consequently, the photo sensor 500 may adjust the luminance corresponding to the ambient light in the dark stage, the intermediate stage or the bright stage. Here, a gamma compensation circuit 600 adjusts the dark stage, the intermediate stage or the dark stage and a luminance corresponding to an ambient light is adjusted corresponding to an emission time of a pixel. Pulse width information for a gamma compensation coefficient and an emission control signal are stored and included in the control signal.

The gamma compensation circuit 600 adjusts a magnitude of a voltage between respective gradations according to the gamma compensation coefficient stored in the control signal from the photo sensor 500, and compensates a data signal. That is, a variation in the magnitude of a voltage between respective gradations according to the gamma compensation coefficient causes a difference between respective gradations to be recognized.

Figure 3:
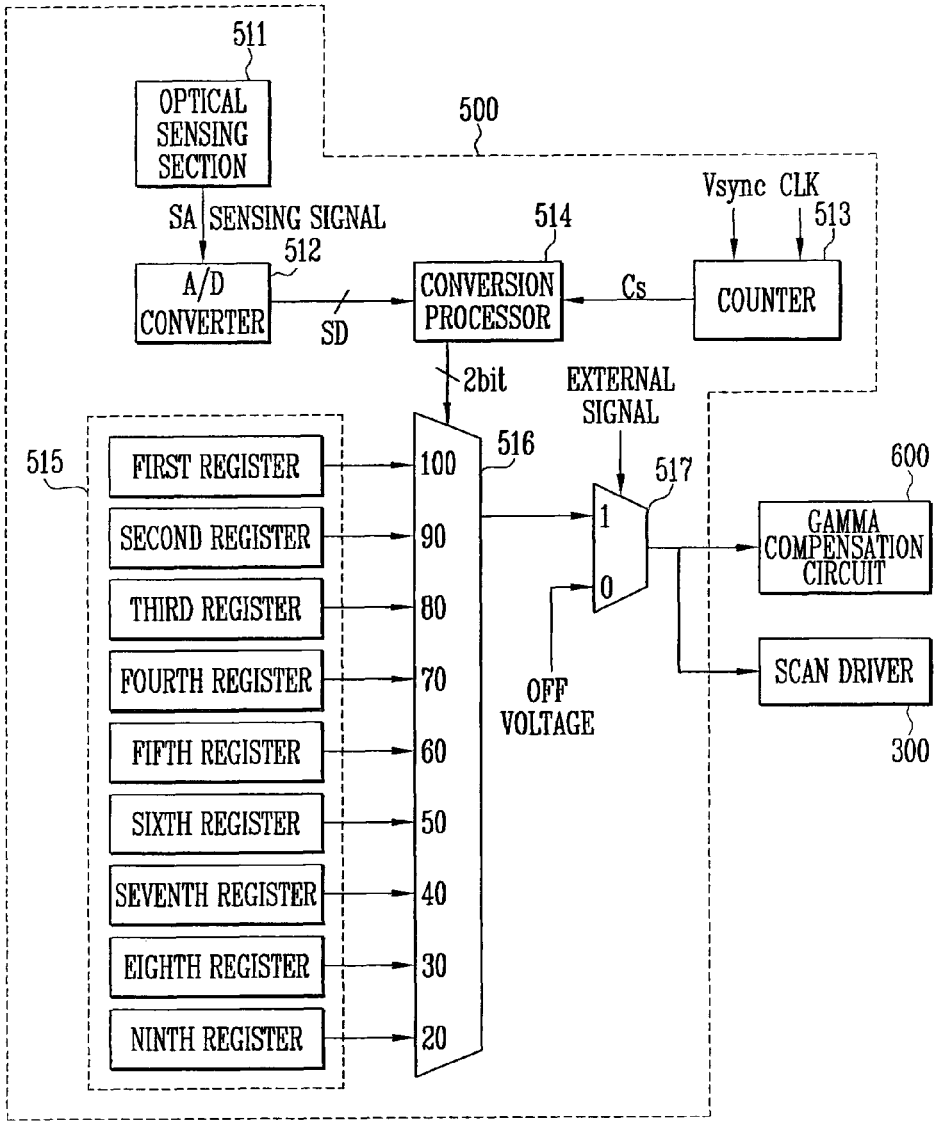
FIG. 3 is a block diagram showing an embodiment of the photo sensor, and the gamma compensation circuit and scan driver of FIG. 2.

FIG. 3 is a block diagram showing an embodiment of the photo sensor, and the gamma compensation circuit and scan driver of FIG. 2. As shown in FIG. 3, the photo sensor 500 provides an output to the gamma compensation circuit 600 and the scan driver 300.

One embodiment of the photo sensor 500 includes an optical sensing section 511, an analog-to-digital (A/D) converter 512, a counter 513, a conversion processor 514, a plurality of registers 515, a first selector 516 and a second selector 517. The optical sensing section 511 measures a brightness of an ambient light, divides it into a plurality of stages, and outputs an analog sensing signal corresponding to the stages. The A/D converter 512 compares the analog sensing signal from the optical sensing section 511 with a reference voltage, and outputs a digital sensing signal corresponding to the compared result. Different voltages can be used as the reference voltage in the case in which the ambient light becomes brighter and the case in which the ambient light becomes darker. That is, by applying a hysteresis, the reference voltage is set to VH1 and VH2 when the ambient light has a bright stage. The reference voltage is set to VM1 and VM2 when the ambient light has an intermediate stage. The reference voltage is set to VL1 and VL2 when the ambient light has a dark stage. Here, a voltage of VH2 is set to be greater than that of VH1. A voltage of VM2 is set to be greater than that of VM1. A voltage of VL2 is set to be greater than that of VL1. Further, when the ambient light becomes darker, the reference is set to VL1 in the dark stage, VM1 in the intermediate stage, and VH1 in the bright stage. When the ambient light becomes brighter, the reference is set to VL2 in the dark stage, VM2 in the intermediate stage, and VH2 in the bright stage. The hysteresis will be described in detail with reference to FIG. 6.

Referring back to FIG. 3, the counter 513 counts a predetermined number and outputs a corresponding counting signal (Cs). For example, where the counter 513 uses a binary value of 2 bits, when the vertical synchronous signal (Vsync) is input to the counter 513, it is initialized as a value of '$00_{(2)}$.' Next, the counter 513 sequentially shifts a clock signal CLK and counts a number up to '$11_{(2)}$.' Then, the Vsync is input to the counter 513, the counter 513 is reset at an initialization state. Through the aforementioned operation, the counter 513 sequentially counts the number from '$00_{(2)}$' to '$11_{(2)}$' during one frame period, and outputs a Cs corresponding to the counted number to a conversion processor 514.

The conversion processor 514 maintains the sensing signal from the optical sensing section 511 while the counter 513 is counting the predetermined number. Further, the conversion processor 514 outputs a select signal corresponding to one selected by a user corresponding to the dark stage, the intermediate stage or the bright stage.

That is, when the conversion processor 514 receives a predetermined signal from the counter 513, it outputs the sensing signal from the A/D converter 512, and maintains the output sensing signal during one frame period. The conversion processor 514 resets a sensing signal maintained during a previous frame period when a next frame period comes. The conversion processor 514 again outputs a sensing signal output from the A/D converter 512 and maintains it during one frame period. For example, when an ambient light is in a brightest state, the conversion processor 514 outputs a sensing signal of '11', and maintains the sensing signal of '11' during one frame period when the counter 513 is counting the predetermined number. When the ambient light is in a darkest state, the conversion processor 514 outputs a sensing signal of '00', and maintains the sensing signal of '00' during one frame period when the counter 513 is counting the predetermined number. Further, in the same manner, when an ambient light changes from the bright stage to the intermediate stage, the conversion processor 514 outputs a sensing signal of '10' and maintains it during one frame period. When the ambient light changes from the dark stage to the intermediate stage, the conversion processor 514 outputs a sensing signal of '01', and maintains it during one frame period.

A brightness of the ambient light is divided into three groups including a bright stage, an intermediate stage, and a dark stage. The plurality of registers 515 includes nine registers. Three registers are allotted to each group. A gamma compensation coefficient functions to compensate a gamma of an image signal. A register set value functions to correspond to an emission control signal determining an emission time of a pixel. The gamma compensation coefficient and the register set value are stored in each register. Among register set values stored in a register of the same group, a gamma compensation coefficient has the same value, but a value corresponding to an emission control signal has different values. When a user selects one of the bright stage, the intermediate stage, and the dark stage, a register corresponding to each group of the bright stage, the intermediate stage, and the dark stage is selected, one register is selected from registers included in each group, and a control signal stored in the selected register is output. A gamma compensation coefficient and an emission signal are stored in the control signal. The gamma compensation coefficient is transferred to the gamma compensation circuit 600, and the emission signal is transferred to the scan driver 300. Accordingly, the gamma compensation coefficient compensates a gamma value of an image signal, and the emission signal adjusts a pulse width of an emission control signal output from the scan driver 300.

The first selector 516 selects one of the plurality of registers 515 according to the sensing signal from the conversion processor 514 and a user's selection, and outputs a control signal stored in the selected register.

The second selector 517 receives an external signal for selecting a one bit value. When a value of '1' is selected in the second selector 517, the second selector 517 causes a signal corresponding to an output signal of the photo sensor 500 to be output, thereby controlling a luminance corresponding to an ambient light. When a value of '0' is selected in the second selector 517, the second selector 517 causes a predetermined signal to be output irrespective of the sensing signal of the optical sensing section 511, thereby expressing an image with a predetermined luminance regardless of the ambient light.

The gamma compensation circuit 600 performs a gamma compensation according to the gamma compensation coefficient included in the control signal of the register 515 selected by the first selector 516. Here, the gamma compensation is performed by R, G, and B.

Accordingly, the photo sensor 500 senses an ambient light, and adjusts a luminance of the pixel portion 100 according the sensed ambient light. In particular, when the ambient light is bright, the photo sensor 500 increases the luminance of the pixel portion 100. In contrast to this, when the ambient light is dark, the photo sensor 500 reduces the luminance of the pixel portion 100.

Figure 4:
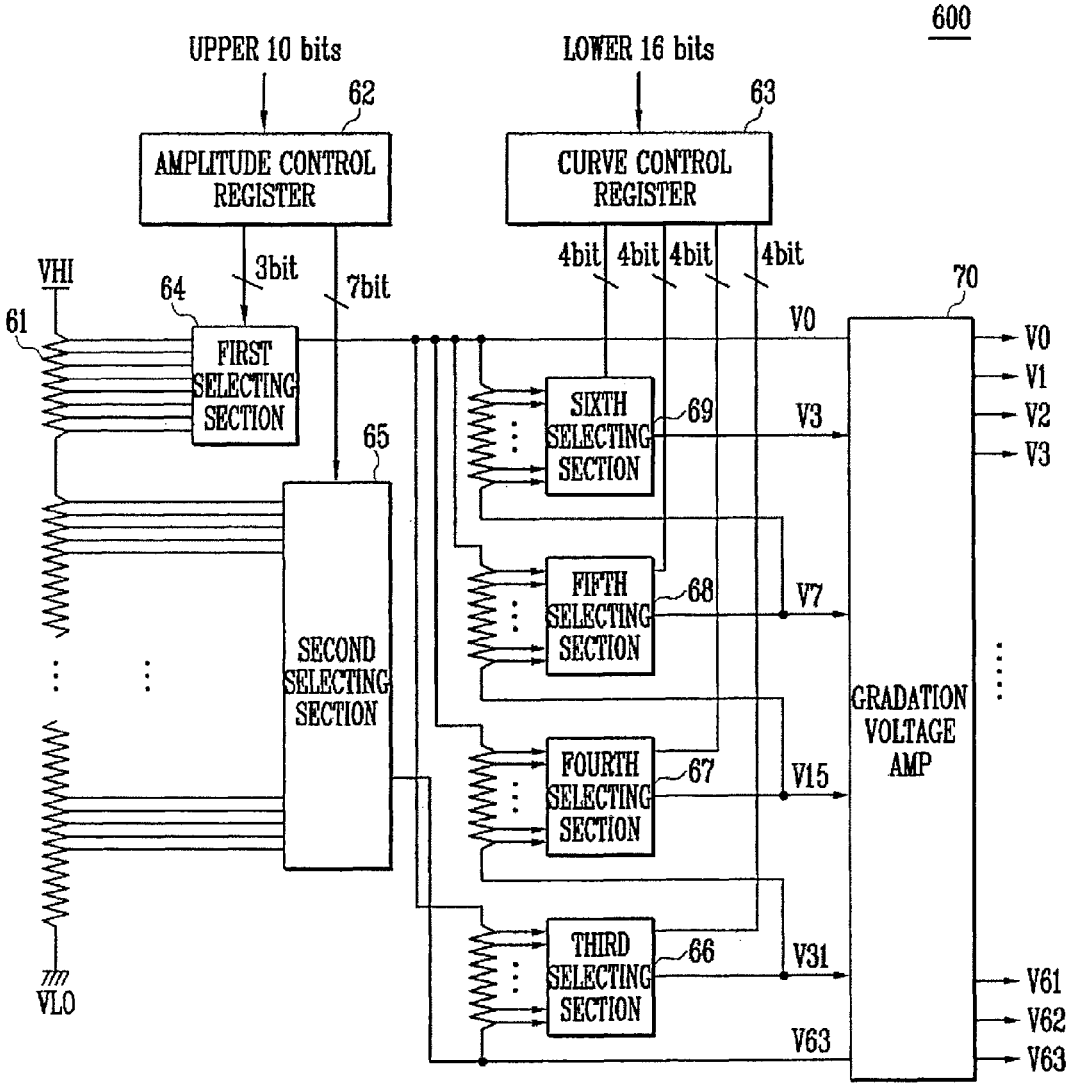
FIG. 4 is a block diagram showing an embodiment of the gamma compensation circuit connected to the photo sensor shown in FIG. 3.

FIG. 4 is a block diagram showing an embodiment of the gamma compensation circuit connected to the photo sensor shown in FIG. 3. With reference to FIG. 4, the embodiment of the gamma compensation circuit 600 includes a ladder resistor 61, an amplitude control register 62, a curve control register 63, a first selecting section 64, a second selecting section 65, a third selecting section 66, a fourth selecting section 67, a fifth selecting section 68 and a sixth selecting section 69, and a gradation voltage amplifier 70.

The ladder resistor 61 generates a plurality of gradation voltages. The ladder resistor 61 includes a plurality of variable resistors between the lowest stage voltage VLO and a reference voltage serially coupled to each other. The highest-stage voltage VHI is set as the reference voltage. Further, when a resistance value of the ladder resistor 61 is set to be small, a control range of an amplitude decreases but a precision of the control amplitude is enhanced. In contrast to this, when a resistance value of the ladder resistor 61 is set to be great, a control range of an amplitude increases but a precision of the control amplitude is deteriorated.

The amplitude control register 62 outputs a register set value of 3 bits to the first selecting section 64, and outputs a register set value of 7 bits to the second selecting section 65. Here, an increase in the number of set bits may increase the number of gradations that may be selected, and a change in the register set value may select a different gradation voltage.

The curve control register 63 outputs a register set value of 4 bits to third selecting section 66, fourth selecting section 67, fifth selecting section 68 and sixth selecting section 69. Here, the register set value can be changed, and a gradation voltage to be selected can be adjusted according to the register set value.

The upper 10 bits and the lower 16 bits among control signals stored in the plurality of registers 515 are input to the amplitude control register 62 and the curve control register 63, respectively, and are selected as a register set value.

The first selecting section 64 selects a gradation voltage corresponding to a register set value of 3 bits output from the amplitude control register 62 among a plurality of gradation voltages divided by the ladder resistor 61, and outputs it as the highest gradation voltage.

The second selecting section 65 selects a gradation voltage corresponding to a register set value of 7 bits output from the amplitude control register 62 among a plurality of gradation voltages divided by the ladder resistor 61, and outputs it as the lowest gradation voltage.

The third selecting section 66 divides a voltage between the highest gradation voltage from the first selecting section 64 and the lowest gradation voltage from the second selecting section 65 into a plurality of gradation voltages through a plurality of resistor rows, and selects and outputs a gradation voltage corresponding to a register set value of 4 bits.

The fourth selecting section 67 divides a voltage between the highest gradation voltage from the first selecting section 64 and the gradation voltage from the third selecting section 66 into a plurality of gradation voltages through a plurality of resistor rows, and selects and outputs a gradation voltage corresponding to a register set value of 4 bits.

The fifth selecting section 68 selects and outputs a gradation voltage corresponding to a register set value of 4 bits among the output gradation voltages of the first and fourth selecting sections 64 and 67.

The sixth selecting section 69 selects and outputs a gradation voltage corresponding to a register set value of 4 bits among the output gradation voltages of the first and fifth selecting sections 64 to 68.

In the aforementioned operation, a curve of a middle gradation part can be controlled according to a register set value of the curve control register 63 that allows gamma characteristics to be adjusted suited to the characteristics of respective light emitting diodes. Moreover, in order to make a gamma curve characteristic convex downwardly, a resistance of the ladder resistor 61 is adjusted to increase a potential difference between respective gradations as a small gradation is expressed. In contrast to this, so as to make a gamma curve characteristic convex upwardly, a resistance of the ladder resistor 61 is adjusted to reduce a potential difference between respective gradations as a small gradation is expressed.

The gradation voltage amplifier 70 outputs a plurality of gradation voltages corresponding to a plurality of gradations to be expressed.

Figure 5A:
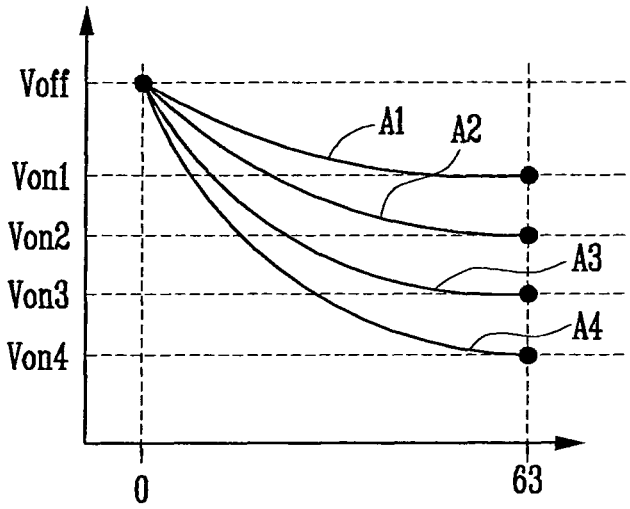
FIG. 5*a* and FIG. 5*b* are graphs showing gamma curves of a gamma compensation circuit.
Figure 5B:
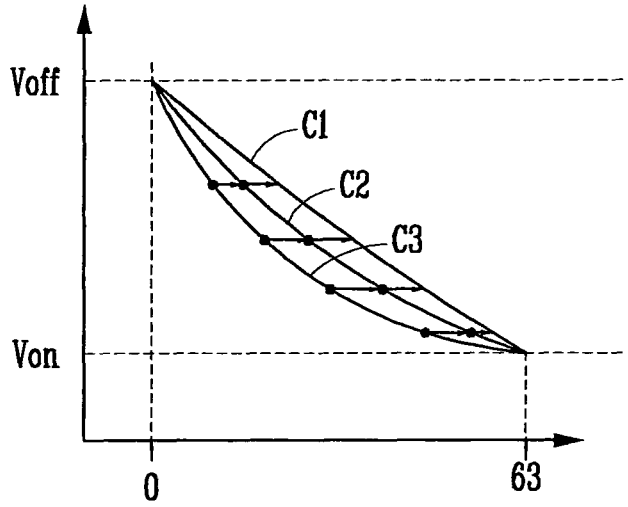

FIGS. 5*a* and 5*b* are graphs showing gamma curves of a gamma compensation circuit. In consideration of fluctuations in characteristics of R, G, and B light emitting diodes, so as to have almost the same luminance characteristics in R, G, and B light emitting diodes, gamma compensation circuits are installed at the R, G, and B light emitting diodes so that an amplitude and a curve through a curve control register 63 and an amplitude control register 62 can be differently set according to the R, G, and B light emitting diodes.

FIG. 5*a* illustrates a case that changes a lower stage gradation voltage according to a gamma compensation coefficient of 7 bits without changing an upper stage gradation voltage to adjust the amplitude of the lower stage gradation voltage. The curve at reference numeral A1 represents a gamma curve corresponding to a sensing signal indicating that an ambient light is in the darkest state. The curve at reference numeral A2 represents a gamma curve corresponding to a sensing signal indicating that an ambient light is in a dark state. The curve at reference numeral A3 represents a gamma curve corresponding to a sensing signal indicating that an ambient light is in a bright state. The curve at reference numeral A4 represents a gamma curve corresponding to a sensing signal indicating that the ambient light is in the brightest state. So as to control the amplitude of a gradation voltage small, a gamma compensation coefficient of the amplitude control register 62 is controlled so that the second selecting section 65 selects the highest stage voltage. In order to control the amplitude of the gradation voltage greatly, it is set that the second selecting section 65 selects the lowest stage voltage.

FIG. 5*b* illustrates a case that changes a middle stage gradation voltage according to a gamma compensation coefficient set in the curve control register 63 without changing upper and lower stage gradation voltages to adjust a gamma curve. A register set value of 4 bits is input to third selecting section 66, fourth selecting section 67, fifth selecting section 68 and sixth selecting section 69, and four gamma values are selected corresponding to the register set value, thereby generating a curve. An off voltage (Voff) is a voltage corresponding to a black gradation (gradation value of approximately zero), whereas an on voltage (Von) is a voltage corresponding to a white gradation (gradation value of 63). A slope change degree of the curve at reference numeral C2 curve is greater than that of the curve of reference numeral C1, and is less than that of the curve at reference numeral C3. With reference to FIG. 5*a* and FIG. 5*b*, by changing a set value of a gamma control register, a gradation voltage is varied to generate a gamma curve. This allows the brightness of pixels 101 included in the pixel portion 100 to be adjusted.

Figure 6:
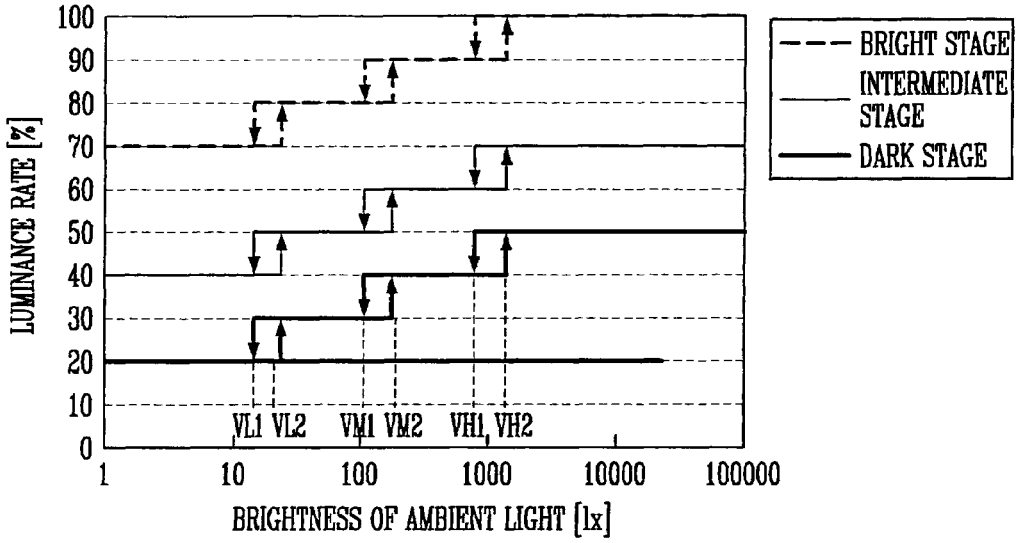
FIG. 6 is a graph showing a hysteresis concept used in the organic light emitting display device according to an embodiment of the present invention.

FIG. 6 is a graph showing a hysteresis concept used in the organic light emitting display device according to an embodiment of the present invention. The hysteresis indicates that the organic light emitting display device responds to a signal late when a strength of the signal is increased or reduced. The organic light emitting display may display device an image in a dark stage, an intermediate stage or a bright stage. A user may select the dark stage, the intermediate stage or the bright stage of the image.

When the user selects an image of the dark stage, when the ambient light is increased from 10(lx) to 100(lx), VL2 is selected as a reference voltage. In contrast to this, when the ambient light is reduced from 100(lx) to 10(lx), VL1 is selected as the reference voltage. Consequently, in a case when the ambient light becomes brighter, when a voltage of the analog sensing signal becomes VL2, a luminance of the organic light emitting display device is varied. In contrast to this, in a case when the ambient light becomes darker, when a voltage of the analog sensing signal becomes VL1, a luminance of the organic light emitting display device is varied. That is, the case where the ambient light becomes brighter uses a greater reference voltage in comparison with the case where the ambient light becomes darker. Accordingly, where the ambient light becomes darker, when the ambient light has a luminance greater than that of the case of a darker ambient light, the luminance of the organic light emitting display device is changed. In contrast to this, where the ambient light becomes brighter, when the ambient light has a luminance less than that of the case of a brighter ambient light, the luminance of the organic light emitting display device is changed.

Accordingly, the organic light emitting display device responds to a luminance change of the ambient light late. When the intermediate stage and the bright stage are selected, the operation is the same as that of the case where the dark stage is selected except that a different reference voltage is set and the hysteresis is applied.

The brightness change effect can be obtained in the organic light emitting display device when the ambient light changes by applying a hysteresis that responds to a luminance change late.

According to an organic light emitting display device and a driving method for the same of the present invention, a user can select one of a dark stage, an intermediate stage, and a bright stage. Further, a luminance may be adjusted according to the stage change of an ambient light so that a user can recognize an image upon the change of the stage. Moreover, the luminance can be adjusted using an emission time to easily control a white balance.

Although exemplary embodiments of the present invention have been shown and described, it will be appreciated by those skilled in the art that changes might be made in this embodiment without departing from the principles and spirit of the invention, the scope of which is defined in the claims and their equivalents.

What is claimed is:

1. A method for driving an organic light emitting display device, the method comprising:

categorizing a luminance of a pixel portion into a plurality of stages, each of the plurality of stages being configured to adjust voltage differences between gradation voltages differently;

receiving a signal from a user for selecting one of the plurality of stages; and adjusting an emission time of the pixel portion corresponding to a sensed brightness of an ambient light in accordance with the selected stage and according to a reference voltage corresponding to the sensed brightness in each of the stages, wherein an increase in the sensed brightness of the ambient light results in an increase in the reference voltage.

2. The method as claimed in claim 1, wherein the plurality of stages comprise a dark stage, an intermediate stage, and a bright stage.

* * * * *